United States Patent [19]

Parker

[11] 4,335,159

[45] Jun. 15, 1982

[54] METHOD FOR DEVELOPING LATENT ELECTROSTATIC IMAGES

[75] Inventor: Delmer G. Parker, Irondequoit, N.Y.

[73] Assignee: Xerox Corporation, Stamford, Conn.

[21] Appl. No.: 94,530

[22] Filed: Nov. 15, 1979

Related U.S. Application Data

[60] Continuation of Ser. No. 728,803, Oct. 1, 1976, abandoned, which is a division of Ser. No. 615,658, Sep. 22, 1975, Pat. No. 4,050,413.

[51] Int. Cl.[3] ..... B05D 3/06

[52] U.S. Cl. ..... 427/14.1; 118/657; 118/658; 427/27

[58] Field of Search ..... 118/657, 658; 427/14.1, 427/27

[56] References Cited

U.S. PATENT DOCUMENTS 3,645,770 2/1972 Flint ..... 118/637

3,985,099 10/1976 Nagashima et al. ..... 118/658

*Primary Examiner*—Bernard D. Pianalto

*Attorney, Agent, or Firm*—Bernard A. Chiama

[57] ABSTRACT

A method comprising a magnetic brush development system within a photocopier that circulates developer by the use of magnetic rollers includes deflecting members interposed between the rollers that are oscillated laterally to maintain homogeneity of developer circulating over the rollers.

3 Claims, 9 Drawing Figures

METHOD FOR DEVELOPING LATENT ELECTROSTATIC IMAGES

This is a continuation of divisional application Ser. No. 728,803, filed Oct. 1, 1976, now abandoned, which was divided from U.S. application Ser. No. 615,658, filed Sept. 22, 1975, now U.S. Pat. No. 4,050,413.

BACKGROUND OF THE INVENTION

This invention relates to apparatus for developing a latent electrostatic image wherein a magnetic brush development system develops a latent electrostatic image supported on an image retaining member to make it visible, and more specifically, this invention relates to a magnetic development apparatus in which improved control is afforded over the developer materials during the imaging process.

For example, in the art of xerography, a xerographic plate, usually comprising a photoconductive surface placed over a conductive backing, is first charged uniformly and then exposed to a light image of an original to be reproduced. Under the influence of the light image, the photoconductive surface is discharged to form what is known as a "latent electrostatic image". Conventionally, the latent image is developed by contacting the charged image areas with an oppositely charged toner material which has been specifically developed for this purpose. The oppositely charged toner particles are electrostatically attracted into the charged image areas thus making the latent image visible.

In theory, areas of greater charged density should be developed as areas of high toner density while areas of lesser charge concentration should be proportionally less dense. However, in practice, this has been found to be difficult. Large "solid" areas of charge concentration supported on a surface, such as a photoconductive plate, typically exhibit a non-uniformity of development when contacted with a toner material. It is believed that the flux density of the electrostatic force field associated with the solid areas varies with the stronger forces located along the fringes or edges of the images. The edge areas, therefore, develop at a faster rate than the interior areas although both are similarly charged. Because of the phenomena, solid areas which must be developed within a relatively short time period, as in automatic xerographic machines, often appear washed out or underdeveloped.

In multiple roller magnetic brush development systems there are several types of "image history" effects that can be caused by the developer traveling through the development zone in a straight line. One type of effect is where toner is scavenged or reclaimed by undertoned developer that overtakes a medium density image area after having previously given up a substantial part of its toner to develop a dense image area circumferentially ahead of the medium image.

Various inventions have been advanced with the idea being to enhance solid area development, among those being U.S. Pat. No. 3,638,611 which discloses an increase in uniformity of development by the use of a biased development electrode with pins attached that is capable of being moved in a lateral direction substantially perpendicular to the developer flow. In a patent to Donalies et al., U.S. Pat. No. 3,331,355, a development apparatus is shown in which donor loading is effected by directing developer into direct and electrical contact with a biased electrode by dropping a developer mix through an electrode having an array of biased wires on a grid supported over the donor member. Other patents that relate to enhancing solid area development and uniformity in a different manner include U.S. Pat. Nos. 2,846,333; 3,147,472; 3,336,905; 3,380,437; and 3,558,339. International Business Machine Technical Disclosure Bulletin in Vol. 2, No. 2, August 1959, pages 4 and 5 also relates to development of electrostatic images all of which are hereby incorporated by reference.

It is, therefore, an object of this invention to improve xerographic development and overcome the above-noted deficiencies.

A further object of this invention is to reduce image history defects and enhance solid area development.

Yet a further object of this invention is to improve automatic xerographic development by providing a developing apparatus that provides a control over the developer material whereby image areas of varying sizes and densities are developed uniformally.

These and other objects of the present invention are obtained by inserting a comb or weir-like oscillating structure between successive magnetic brush rollers in the region where developer is transferred from one roller to the next, developer that has been used to develop at one position on one roller can be directed to a new position on the next. Scattering developer between development steps will tend to eliminate or reduce any non-homogeneities in the toner distribution created by an earlier development process.

For a better understanding of the invention as well as other objects and further features thereof, reference is had to the following detailed description of embodiments of the invention to be read in connection with drawings wherein:

DETAILED DESCRIPTION OF THE PREFERRED EMBODIMENTS

Figure 1:
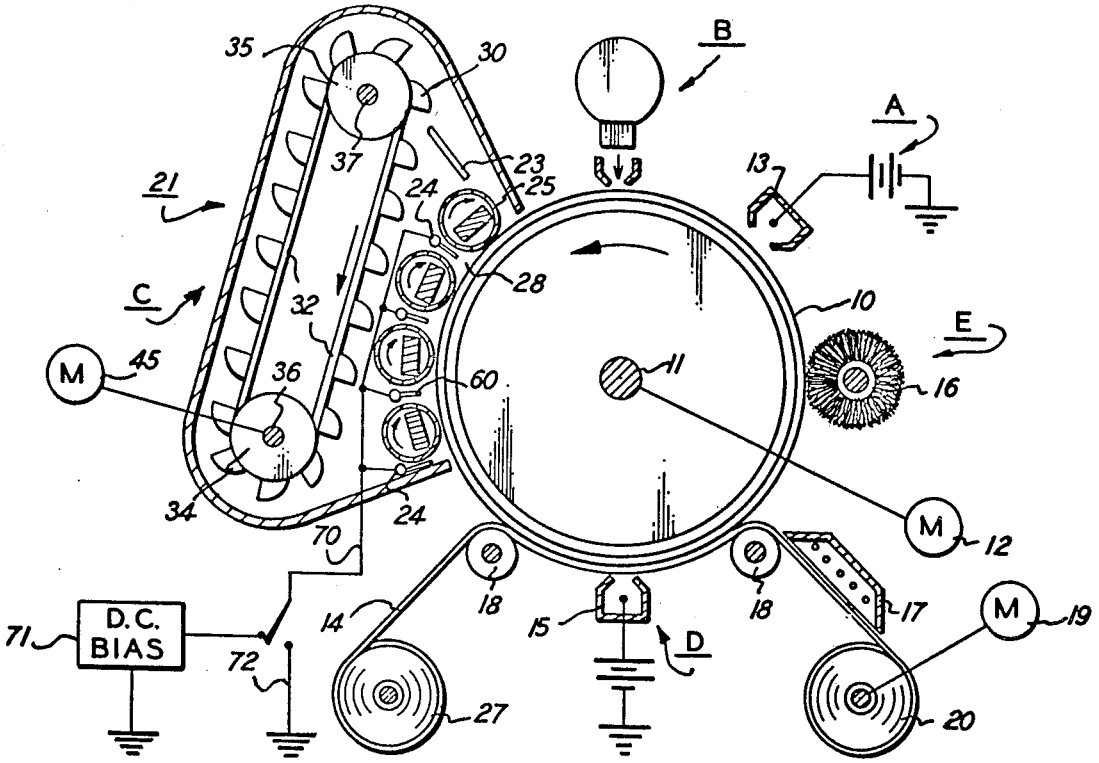
FIG. 1 is a schematic view of an automatic reproducing machine employing the developing apparatus of the present invention.

There is illustrated schematically in FIG. 1 an exemplary continuous xerographic apparatus containing an embodiment of the xerographic developing system of this invention comprising a member interposed between developer members such as rollers to maintain homogeneity of developer within the developer system.

It should be understood that any copying process can be used wherein developer is brought to an imaging surface by donor members. Xerography is used here only as an example. Also, magnetic brush development is used herein only as an example, other arrangements such as magnetic belts and other donor members can also be used.

As illustrated in FIG. 1, the xerographic apparatus comprises a xerographic plate including an imaging surface such as a photoconductive layer or light receiving surface placed on a conductive backing and formed in the shape of a drum, generally designated by number 10, which is mounted upon shaft 11 journaled to the frame (not shown) to rotate in the direction indicated by the arrow to cause the drum to pass sequentially through a plurality of xerographic processing stations. Drum 10 is rotated at a constant rate through the drive action of a synchronous motor 12.

For the purpose of the present disclosure, the several xerographic processing stations in the path of movement of the drum surface may be described as follows:

A charging station A, at which a uniform electrostatic charge is deposited on the photoconductive layer of the drum surface by means of a corona discharge device 13 of the type disclosed in U.S. Pat. No. 2,777,957;

An exposure station B, at which a light or radiation pattern of an original to be reproduced is projected onto the drum surface to dissipate the charge found thereon in the exposed areas thereby forming a latent electrostatic image thereon, the exposure station being positioned adjacent to the charging station in the direction of drum travel;

A development station C, at which a xerographic developing material including toner particles having an electrostatic charge opposite to the electrostatic latent image charge are brought into contact with the image-bearing drum surface whereby the toner particles adhere to the electrostatic latent image in configuration to the original to be reproduced thereby making the latent image visible;

A transfer station D, at which the xerographic powder image is electrostatically transferred from the drum surface to a final support material 14 by means of a second corona generating device 15 similar to that used in the charging station;

A cleaning station and discharge station E, at which the drum surface is brushed by means of a rotating cylinder brush 16 to remove residual toner particles remaining thereon after image transfer.

In the present embodiment, the final support material 14 is mounted on a supply spool 27 in a web configuration and is transported through the heat fuser 17 wherein the developed and transferred powder image on the web surface is permanently affixed thereto. The web is guided by a set of idler rollers 18 and driven through the transfer station in synchronous moving relation with the drum surface by means of synchronous drive motor 19 acting through a take-up spool 20.

Figure 2:
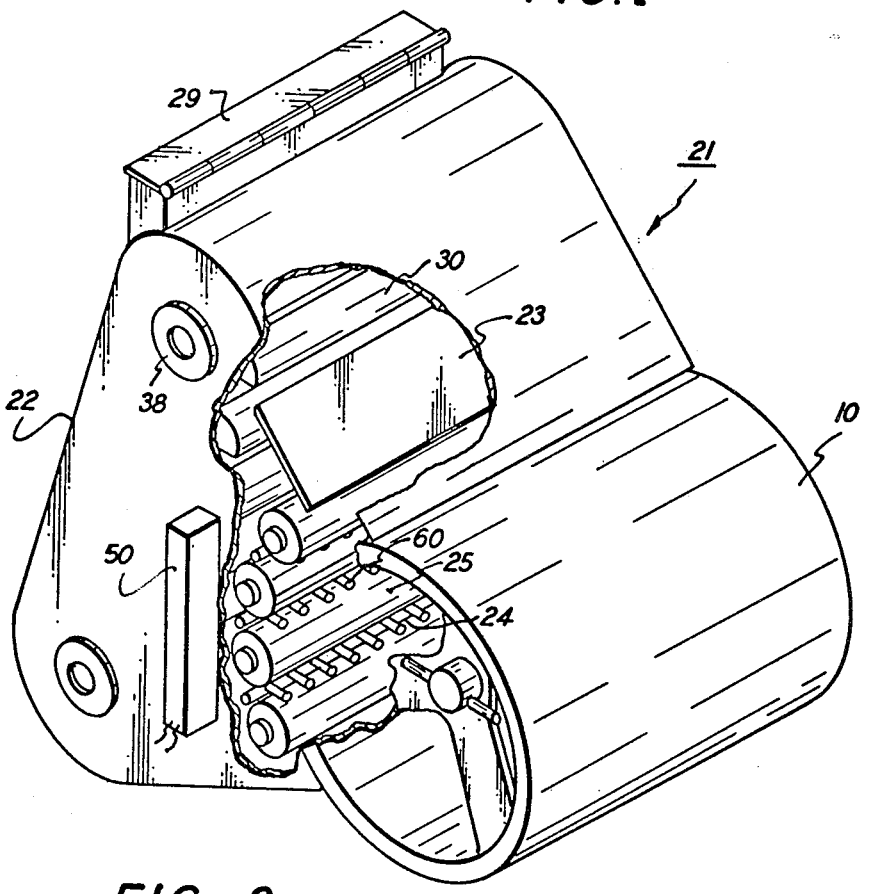
FIG. 2 is an enlarged partial perspective view showing the developing apparatus of the present invention illustrated in FIG. 1.
Figure 3:
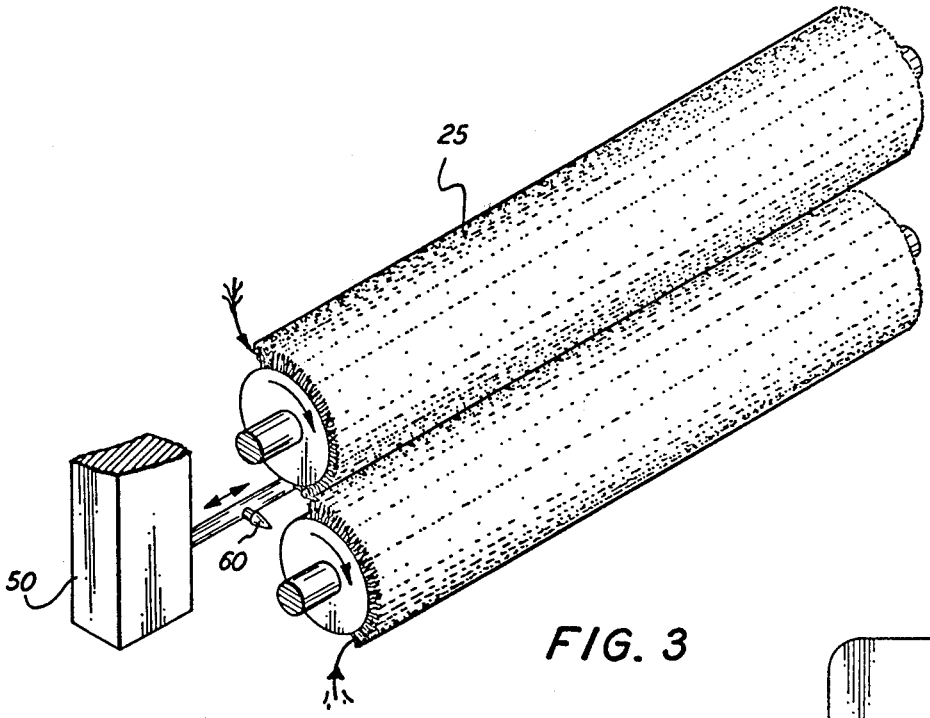
FIG. 3 is a perspective of the magnetic roller and an alternative embodiment of the comb-shaped member of FIGS. 1 and 2.
Figure 4:
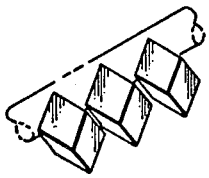
FIG. 4 is an enlarged perspective showing a portion of the comb-shaped member of FIG. 2.
Figure 5:
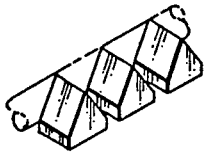
FIG. 5 is an anternative embodiment of the comb-shaped member of FIG. 2.
Figure 6:
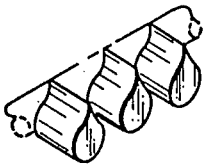
FIG. 6 is another alternative embodiment of the comb-shaped member of FIG. 2.
Figure 7:
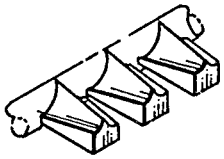
FIG. 7 is yet another alternative embodiment of the comb-shaped member of FIG. 2.

Referring now to FIGS. 1 and 2, there is shown a preferred embodiment for mixing the toner as it travels to a magnetic brush donor member in accordance with the present invention. The invention can be used with a variety of developer materials. For example, single and multiple component developer material systems can take advantage of the invention.

The term "two-component developer material" as herein used, refers to a material employed to develop latent electrostatic images, the material comprising a relatively large "carrier" bead to which toner particles are attracted and held. The carrier and the toner materials are preselected from materials which are triboelectrically remote so that they interact when brought into rubbing contact to charge the materials to opposite potentials. Conventionally, the carrier will assume a positive charge while the toner assumes a negative charge if the plate is charged positive. The toner is loaded on the carrier beads and the beads brought into contact with a latent electrostatic image supported upon a member, such as a xerographic plate, where the toner particles are electrostatically transferred from the bead surface to the more highly charged image areas. This term encompasses developers having additional additives therein also.

A "one-component" magnetic developer material can also be used to serve the dual function of carrier and toner.

It has been shown that a two component developer material moving through an enclosed development zone, such as between magnetic rollers or magnetic belts and a photoconductive plate as herein disclosed, after passing through the introductory region tends to become compacted. That is, the particulate material moves in a unitized mass with the particles in contact with each other when flowing through an extended, enclosed, region.

As will be explained in greater detail below, the apparatus of the present invention provides a developing system having means to disperse developer material moving in a restricted flow zone between the magnetic brush rollers and the photoconductive plate in the form of a comb or weir-like oscillating structure that is placed between successive magnetic brush rollers and causes developer that has been used to develop at one position on one roller to be directed to a new position on the next roller. Scattering or mixing developer between development steps will tend to eliminate any non-homogenities in the toner distribution created by an earlier development process.

The means for eliminating developer non-homogeneity which is disclosed in more detail below comprises a homogenizing means that is located substantially perpendicular to the developer flow and oscillates laterally to the developer flow. While the preferred location of the homogenizing means is substantially perpendicular to the developer flow, it can be located at any angle in relation to the developer flow as long as the developer strikes the homogenizing means in route to magnetic donor members. In this manner, particulate material is scattered and mixed within the developer flow as a result of being interrupted by the homogenizing means and translated laterally to a new path. Toner that was on one area of the development zone will be dispersed to a new location in the development zone. The movement of the homogenizing means or member transverse to the direction of rotation of the drum 10 also tends to eliminate compaction of toner which sometimes happens after the developer has passed through an enclosed development zone such as between the magnetic rollers and the photoreceptor.

The mixing structure can be made out of a conductive material and connected by lead line 70 either through a.c. or d.c. voltage bias supply 71 or directly to ground through lead line 72. This type of construction will provide an additional path, particularly for charged carrier traveling near the outer developer surface to discharge and help maintain developer charge equilibrium and thereby maintain better control over the development.

The shape of the individual mixing elements interposed between the magnetic rollers can be relected to control the developer scattering properties in some desirable fashion. Air foil, plow-shaped, comb-shaped, flat vane, and wedge-shaped are just a few examples of the shapes that can be used.

In order to effect development of the electrostatic latent image on the cylindrical xerographic plate, the developing system includes as shown a developer apparatus generally referred to numerically as 21, which co-acts with a cylindrical xerographical drum 10 to form a development area wherein the charged and exposed surface of the drum is capable of being developed to form a visible powder image of the original to be copied.

For this purpose, a developer housing 22 is mounted adjacent to the xerographic drum as illustrated in FIG. 1. Mounted within the developer housing is a driven bucket-type conveyor used to gather and transport two-component developer material, although one-component developer could be used, previously supplied to the developer housing, to the upper portion of the housing where the material is guided through an introductory region into the active development zone 28 by means of an entrance chute 23. Members 24 that are comb or weir-like are mounted within the developer housing in spaced relation to the drum and are interposed between successive magnetic rollers or donor members 25. As the developer material is introduced into the upper part of the development zone, the material is caused to flow downwardly through the development zone wherein toner particles on the developer material adhere electrostatically to the previously formed latent images on the drum surface and the remaining developer material passes through the bottom opening of the development zone back into the sump or supply area of the developer housing. Toner particles, consumed during the developing operation to form the visible powder images, are replenished by means of a toner dispenser 29 mounted on the top portion of the developer housing in FIG. 2.

A suitable bucket-type conveyor is used to convey the developer material from the reservoir or sump portion of the developer housing to the upper portion of the housing from where the material is gravity fed through the development zone. In this embodiment, the bucket type conveyor consists of a series of parallel spaced buckets 30 secured by rivets or the like to a pair of conveyor belts 32 which are wrapped about conveyor drive pulleys 34 and conveyor idler pulleys 35 secured to drive the idler shafts 36 and 37, respectively. The two shafts 36 and 37 are rotatably supported in parallel relation in bearing blocks 38 (FIG. 2) provided in the parallel opposed side walls of the developer housing 22. The drive shaft 36, which is securely journaled for rotation within the bearing blocks 38 passes exterior the developer housing and is operatively connected to motor 45 wherein the bucket conveyor moves in predetermined time relation with the xerographic drum surface in the direction indicated. Other types of conveyor systems could also be used to transport the developer to the development zone if desired, for example, magnetic belts.

To properly introduce the developer material into the development zone, and to spread this material longitudinally across the face of the drum surface as the material is emptied out of the conveyor buckets by gravity, an input chute 23 is secured as by welding the end flanges (not shown) of the chute to the sidewalls of the developer housing.

In the present invention a developer material is introduced by the conveyor system onto chute 23 and from there is propelled into the developer zone by gravity and magnetic rollers 25. Comb or weir-like means are spaced from and located between successive magnetic rollers and by their location scatter developer that is being transferred from one roller to the next. Scattering or redistribution of toner that takes place during this step of the development process homogenizes toner created by an earlier development process. In this way, image history effects that can be caused by the developer traveling through the development zone in a straight line are lessened. An example is where toner is scavenged or reclaimed by developer that overtakes a medium density image after having given up a substantial part of its toner to develop a dense image. The member used to scatter developer is journaled (not shown) to actuating or oscillating means 50 so that, as the developer is scattered as it falls through the development zone by the member of homogenizing means 24 it can also be translated transverse, laterally or axially to the developer flow in order to further homogenize the two component developer by the oscillating means. The oscillating means can be of any conventional construction such as is shown in FIG. 2 of U.S. Pat. No. 3,638,611.

Figure 9:
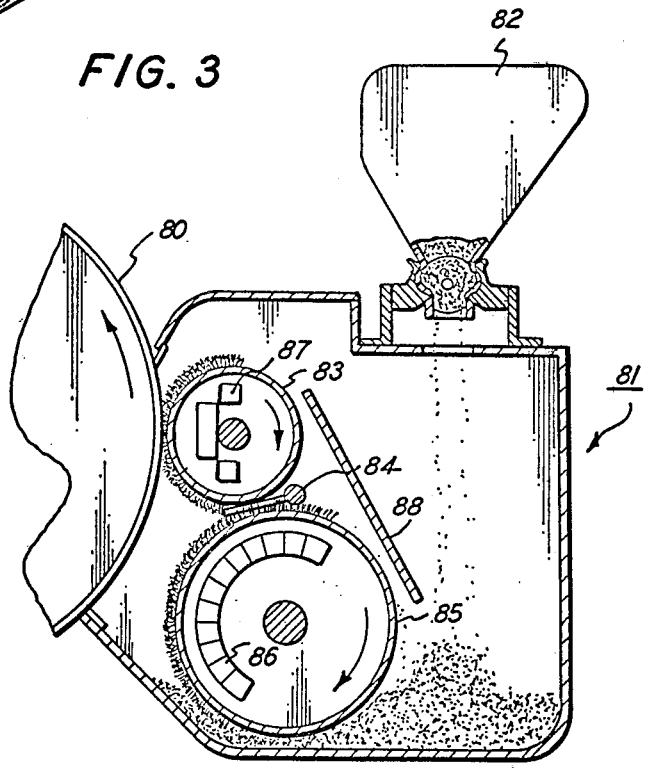
FIG. 9 is a partial schematic of an alternative embodiment of the developing apparatus of the present invention.
Figure 8:
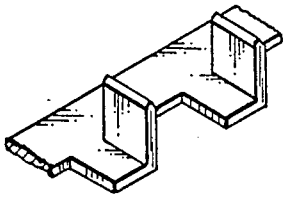
FIG. 8 is yet another alternative embodiment of the comb-shaped member of FIG. 2.

It should be understood that homogenizing means 60 in FIG. 1 and 84 in FIG. 9 are shown located in the passive zone of the development area as opposed to the active zone of the development area, the active zone of the development area being that area where development of the latent image on the photoreceptor is taking place. The advantage of locating the homogenizing means in the passive zone of development as opposed to the active zone of development as disclosed, for example, in U.S. Pat. No. 3,645,770, is that cross-mixing can take place in the passive zone while toner is being field stripped in the active development zone from the outer surfaces of the developer passing directly adjacent the photoreceptor as the developer is transported from one magnetic roller to the other. Also, locating the comb-like member in the passive zone of the development area allows cross-mixing to take place without disturbing full development at the photoreceptor surface.

Preferably, the comb or weir-like member is located perpendicular to the developer flow and has finger means 60 that are equally spaced so that as the developer falls through the development zone bead mixture is maintained uniform with solid area development thereby being enhanced. However, this member can operate in a non-perpendicular relationship to the developer flow with good results. The member interposed between and spaced from the magnetic rollers can be constructed of either a conductive material or semi-conducting material and by oscillating the comb or weir-like member substantially perpendicular to the developer flow, toner is translated laterally to the developer flow with a more homogeneous mixture being a result.

In reference to the alternative embodiment of the present invention in FIG. 9 a drum 80 with a xerographic plate thereon as described in detail in reference to FIG. 1 is shown being developed by the developing system including an exit (baffle) or chute 88 and which comprises a developer replenisher 82 and at least one developer roller or donor member 83 which has magnets 87 and is supplied one-component magnetic developer into a development zone by transport means 85 which has magnets 86. A homogenizing means or member 84 that can be comb or weir-like in shape is positioned within the development zone between the transport member and donor member and connected to suitable oscillating means such as means 50 discussed in reference to FIG. 1. The comb or weir-like member should be made out of a conductive material and connected either through a bias supply or directly to ground similar to FIG. 1 thereby affording a greater degree of control over developer compactness.

The developer that travels in the development zone is scattered and redistributed as the homogenizing means is oscillated laterally to the direction of developer flow. Developer that leaves the transport roll on one side is moved axially in relation to the developer flow and is attracted to the donor member on the opposite side for development of the image on the xerographic plate.

While this invention has been described in reference to the structure disclosed herein, it is not confined to the details as set forth, and this application is intended to cover modifications or changes as may come within the scope of the following claims.

What is claimed is:

1. A method for improving a magnetic brush development system for developing latent electrostatic images carried by an imaging surface of an electrostatographic processor; said development system including a sump for storing a supply of developer having toner and carrier components, a plurality of magnetic brush rollers located in a development zone adjacent the imaging surface for depositing developer on the imaging surface and means for circulating said developer along a predetermined path running from said sump, through the development zone, and back to said sump, the improved method including the steps of:

placing a member in the region between and spaced from the rollers where developer is transferred from one roller to the next, and oscillating said member in order to translate developer laterally to maintain the homogeneity thereof.

2. The improved method of claim 1 wherein said member is comb-shaped.

3. The improved method of claim 1 wherein said member is weir-like.

* * * * *